United States Patent [19]

Merrick

[11] 4,280,589

[45] Jul. 28, 1981

[54] ELEVATING DEVICE

[76] Inventor: John A. Merrick, P.O. Box 569, Limassol, Cyprus, Canada

[21] Appl. No.: 117,155

[22] Filed: Jan. 31, 1980

[51] Int. Cl.[3] ..... B66F 11/04

[52] U.S. Cl. ..... 182/2; 182/19

[58] Field of Search ..... 182/2, 141, 19

[56] References Cited

U.S. PATENT DOCUMENTS 2,969,849 1/1961 Grant ..... 182/2

FOREIGN PATENT DOCUMENTS 849895 8/1970 Canada ..... 182/2

1101852 4/1955 France ..... 182/2

*Primary Examiner*—Reinaldo P. Machado

*Attorney, Agent, or Firm*—Hirons, Rogers & Scott

[57] ABSTRACT

An elevating device consists of a base frame, usually mounted on running wheels, a turntable on the base frame, a vertical first post on the turntable and first and second arm means mounted on the post. The first arm means is a parallelogram linkage connecting the first post and a second post, so that the second post stays vertical as it moves up and down. The second post is skewed along its length so that the two arm means can move alongside each other into the stored position; it is therefore exceptionally compact in that position. The second arm means telescopes and a man-carrying platform is pendulously suspended at its outer end. A linkage including a telescoping shaft connects the second post and the platform to hold the platform against inadvertent movements; the linkage includes a spring connection to prevent damage thereto under accidental impacts. The movements of the first arm means relative to the first post, the second arm means relative to the second post, and the telescoping of the second arm means are under the control of respective separate hydraulic piston and cylinder motors.

9 Claims, 4 Drawing Figures

ELEVATING DEVICE

FIELD OF THE INVENTION

This invention is concerned with improvements in or relating to elevating devices capable of functioning for example as a hoist, or man-carrying device.

REVIEW OF THE PRIOR ART

A prior elevating device is described in my prior U.S. Pat. No. 3,807,575 issued Apr. 30, 1974, consisting of two pairs of vertically-extending posts, each pair connected together by a respective parallelogram linkage controlled by a separate motor. The common post is skewed so that the two linkages can move alongside each other and a man-carrying platform is fixed to the upper end post. Such a device primarily moves the platform vertically up and down with only very limited capability of horizontal movement. Added horizontal movement can be provided by making the upper arm means telescope, but the problem then arises of keeping the platform horizontal.

A prior art search among U.S. patents in class 182, sub-class 2 revealed the following patents:

U.S. Pat. Nos. 2,798,623; 2,969,849; 2,998,861; 3,476,193; 3,523,336; 3,768,591; 3,828,939; 3,834,488; 3,891,056; 3,963,095; 4,088,200; and 4,169,511 of which U.S. Pat. No. 2,969,849 is believed to be the most pertinent. This discloses an orchard vehicle with an extensible boom pivotally mounted about a pivot 44 on the upper end of a post 24 and moved up and down by a hydraulic cylinder 78. The platform 64 is pivoted so that it will always tilt downwards and must be held horizontal; to this end there is provided a connection consisting of extensible shaft 82, drums 85 and 86 and connecting cables 88 and 95. U.S. Pat. No. 2,969,849 issued Jan. 31, 1961 to J. E. Grant discloses an orchard vehicle having a telescoping arm pivoted to a vertical post, the outer end of the arm having a man-carrying basket pivoted thereto. The basket is held horizontal by a cable framed around a pulley moulded on a telescoping shaft. A cable is framed around another pulley at the other end of the shaft and is connected to the post, the linkage constituted by the cables, pulleys, etc. acting to keep the basket from tilting away from the vertical as the end of the telescoping arm rises and falls. Any failure of the linkage results in dangerous downward tilting of the basket.

DEFINITION OF THE INVENTION

It is therefore an object of the invention to provide an elevating device having a telescoping elevatable arm means carrying a man-supporting platform.

In accordance with the invention there is provided an elevating device comprising: a base means, a telescoping arm means pivotally connected at one end to the said base means and having a man-carrying platform pivotally pendulously suspended at the other end so as to remain in a vertical attitude under the action of gravity, during movement thereof;

motor means operatively connected between the base means and the telescoping arm means to elevate and lower the platform relative to the base means;

second motor means operatively connected between the telescoping parts of the telescoping arm means to extend and contact it for corresponding movement of the platform;

a telescoping torque transmitting shaft disposed alongside the telescoping arm means and telescopable therewith;

a first link means connecting one end of the telescoping shaft and the base means for rotation of the shaft through an angle corresponding to the pivoting of the second arm means relative to the base means; and a second link means connecting the other end of the telescoping shaft and the platform and movable by said rotation of the shaft to maintain the platform in its said vertical attitude.

DESCRIPTION OF THE DRAWINGS

A device which is a specific embodiment of the invention will now be described, by way of example, with reference to the accompanying drawings, wherein.

DESCRIPTION OF THE PREFERRED EMBODIMENTS

Figure 1:
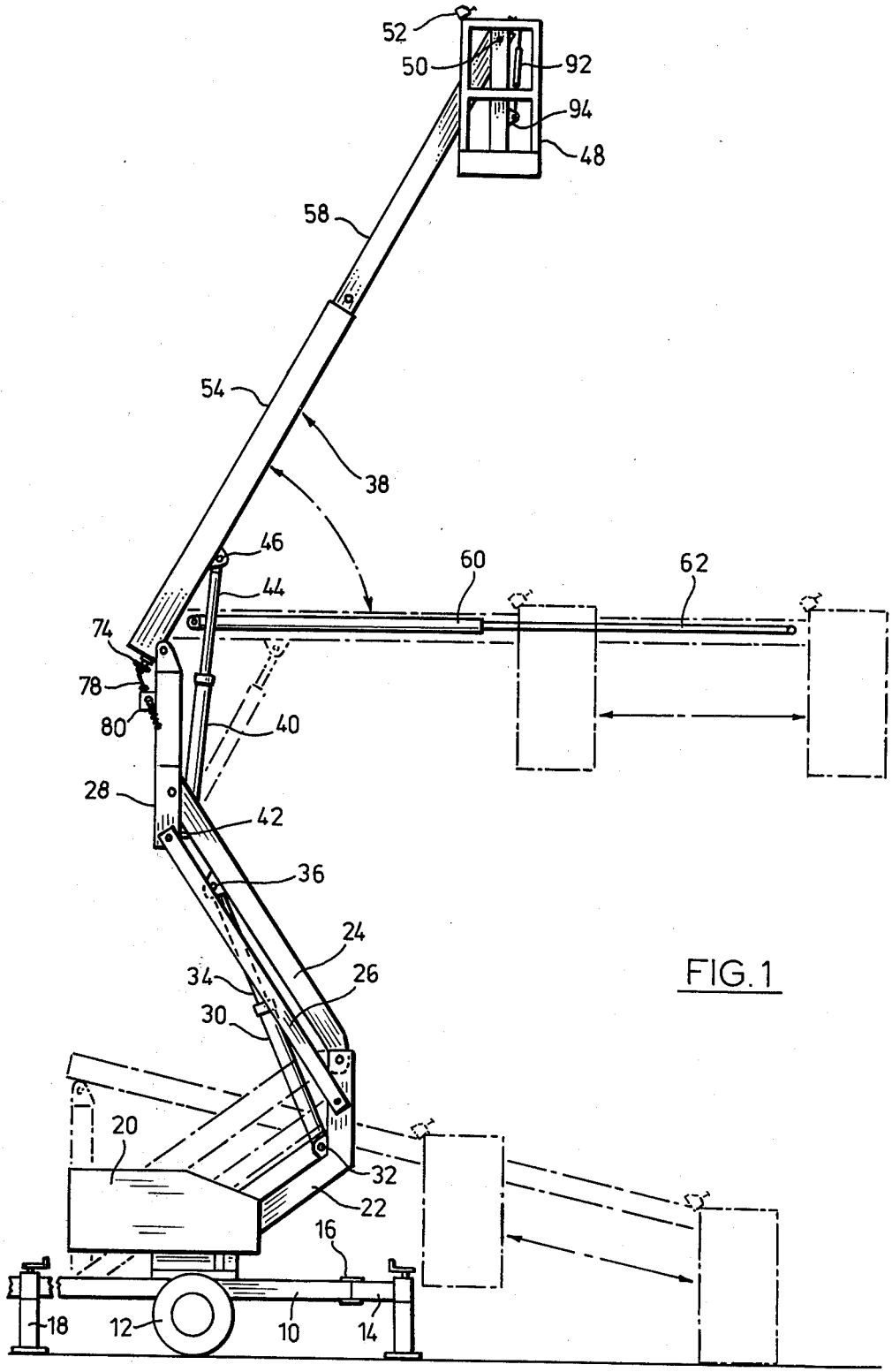
FIG. 1 is a general perspective view of the device showing in solid lines the arm means and man-carrying platform thereof in lower positions.
Figures 2, 3, 4:
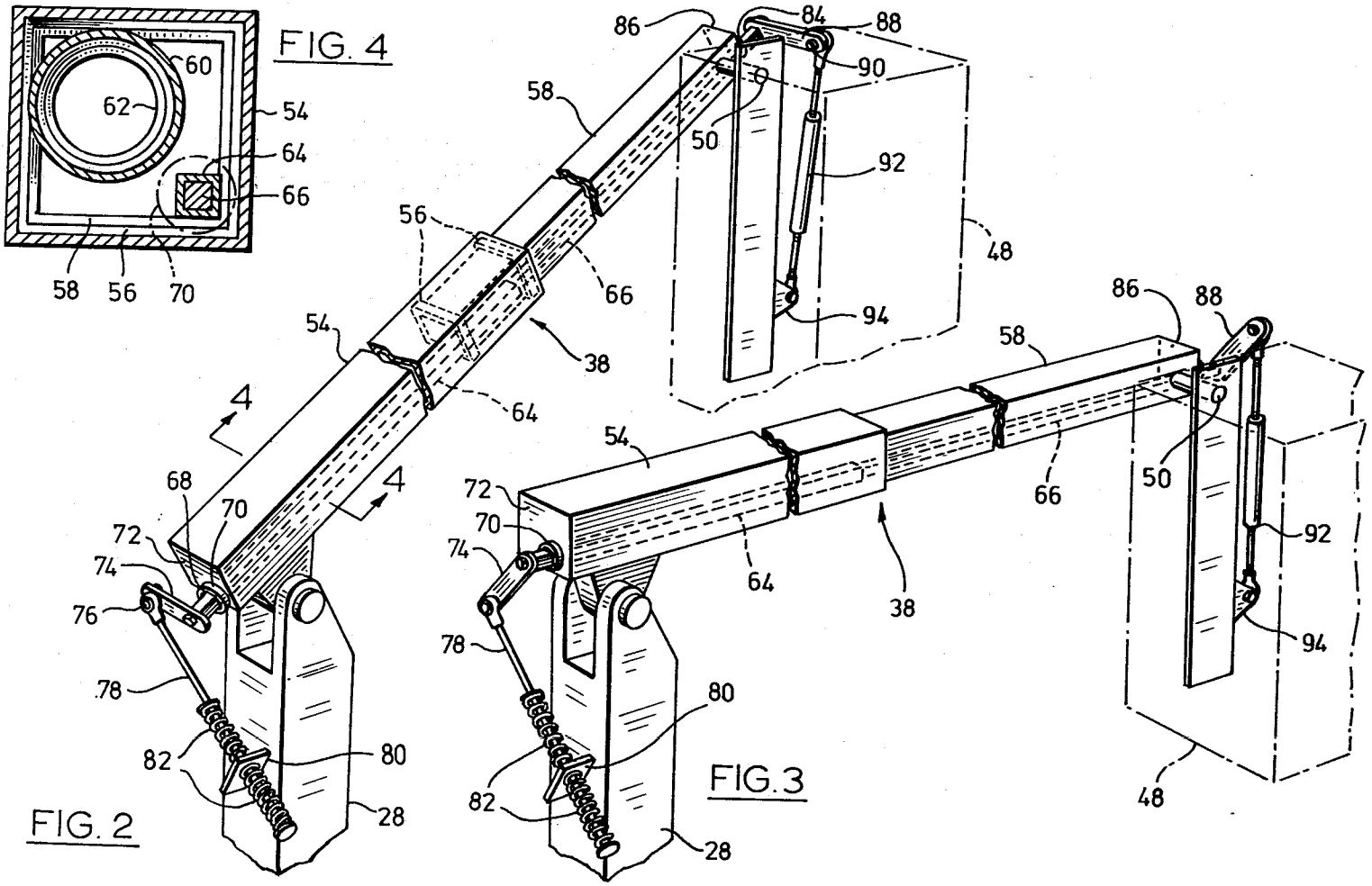
FIG. 2 is a side elevation to an enlarged scale of the upper arm means of the device to show more detail thereof.
FIG. 3 is an end elevation in the direction of the arrow 3 in FIGS. 1 and 2 to show the link connection between the upper arm and the post to which it is connected.
FIG. 4 is a similar view to FIG. 3, taken in the direction of the arrow 4 of FIGS. 1 and 2 to show the link connection between the upper arm and the man-carrying platform.

The device comprises a base frame 10 mounted on two running wheels 12 and provided with brace arms 14 which can be swung about respective pivots 16 from the brace positions illustrated in the drawings to respective stored positions alongside the base frame. Each brace arm is provided at its outer end with a jack 18 engageable in known manner with the ground to stabilize the device while in use.

A turntable frame 20 is mounted on the frame 10 for rotation about a vertical axis and an upright first post member 22 is mounted rigidly thereon. A first lower elongated arm means is constituted by two parallel arms 24 and 26, which are pivotally connected respectively at the upper end of the post member 22. The arms are connected at their other ends by respective pivots to a second post member 28. It will be seen that the upper part of the first post member 22, the lower part of the second post member 28, and the two parallel arms 24 and 26 together form a first parallelogram linkage, so that the second post member will maintain an upright posture as it is moved from the stored position shown in solid lines in FIG. 1, to an elevated position, such as that shown in broken lines in FIG. 1. This first stage of the device is elevated as required by a hydraulic motor, operatively connected between the first and second post members. Thus, in this embodiment the motor is constituted by a hydraulic piston and cylinder unit having one end of the cylinder 30 pivotally connected at 32 to post 22, while the free end of the piston 34 is pivotally connected at 36 to the parallelogram arm 34.

The upper end of the second post member 28 has pivotally connected thereto one end of an upper telescoping arm means indicated generally by reference 38. This second stage of the device is elevated as required, in a similar manner to the first stage, and independently thereof, by means of a second hydraulic motor operatively connected between it and the second post member 28. In this embodiment the second motor is also constituted by a piston and cylinder unit, having the lower end of the cylinder 40 pivotally connected at 42 to the lower end of the second post, while the free end of the piston 44 is pivotally connected at 46 to the arm means 38. A man-carrying platform 48 is pivotally connected at 50 to the other end of the arm means and carries a control unit 52 by which operation of the device is controlled from the platform, the pivot 50 being above the centre of gravity of the platform, whether empty or fully occupied, so that at all times the platform is pendulously suspended and remains upright (as illustrated) in any position of the arm means.

The first post 22 is mounted to one side of the turntable frame 20 and the second post member is of transverse cranked or skewed shape, whereby a vertical plane containing the two arms 24 and 26 is transversely spaced from a corresponding parallel plane containing the telescoping arm means 38. The linkages can therefore move and lie freely alongside one another, as illustrated in solid lines in FIG. 1, when they overlap as seen in side elevation. The two arm means extend in opposite directions, i.e. as considered from their secured ends to their movable ends, but are "in series" with one another when considering the height to which the whole device can elevate the platform. The second arm means 38 even when fully retracted is somewhat longer than the first arm means and so that in the stored position the platform is adjacent one end of the base frame 10 and can easily be mounted by the operator.

In this particular embodiment the second telescoping arm means 38 consists of a hollow outer arm member 54, of square cross-section, in which is mounted by sliding bearing means 56 a hollow inner arm member 58, also of square cross-section. The arm means is extended and retracted as required by a third hydraulic motor mounted within the arm means and operatively connected between the arm members, constituted by a cylinder 60 connected to the outer arm member and a piston 62 connected to the inner arm member. A supplementary link connection includes a telescoping shaft mounted within the arm means 38 alongside the hydraulic motor, consisting of outer and inner shaft members 64 and 66 respectively, so as to be extensible and contractible with the arm means. The shaft members are of non-circular cross-section, preferably square cross-section, to permit transmission of torque from one end to the other.

The end of the outer shaft member 64 adjacent the post 28 has a pivot pin 68 thereon passing through a pivot bearing 70 in an end plate 72 of outer arm member 54, so that the shaft member 64 is held firmly for rotation about a corresponding longitudinal axis. The pin 68 has a radially-extending link arm 74 fixed thereto outside of the arm, this link arm being pivotally connected at 76 to a connecting arm 78. The arm 78 is effectively connected to a bracket 80 fixed to the post 28 by a yielding connection intended to prevent breakage of the telescoping shaft and its associated links, etc. if the platform 48 should receive a heavy impacting blow attempting to pivot it about the axis 50. Thus, the arm 78 passes freely through the bracket and is connected to the opposite outer ends of two compression springs 82 that abut opposite sides of the bracket and thereby hold the arm 78 in a central position as long as the force applied thereto is less than that of either of the springs.

The end of the inner shaft member 66 adjacent the platform 48 also has a pivot pin 84 thereon passing through an end plate 86 of the inner arm member 58, so that the shaft member is held firmly for rotation about the same longitudinal axis as the shaft member 64. The pin 84 has a radially-extending link arm 88 fixed thereto, this link arm being pivotally connected at 90 to a connecting arm 92, which is in turn pivotally connected to a bracket 94 fixed to the platform 48. As the upper means rotates about its pivot with the post 28 the effect of the link connection 74, 78 is to rotate the telescoping shaft 64 66 through a corresponding angle; thus rotation is transmitted through the link connection 88, 92 to the platform so that the latter is held firmly in its pendulous, vertical position without any possibility of pivoting under the effect of movements of the platform and /or of the occupant or occupants thereof.

The device is moved from place to place on the wheels 12; upon stopping the brace arms 14 are swung fully out and the jacks 18 are operated to be in firm contact with the floor. The operator can then extend the upper arm means using parallel controls (not shown) on the turntable frame 20 until the platform 48 is on the floor; he then climbs into the platform while at this position, and by means of the control unit 52 can operate any one of the three hydraulic motors to elevate the platform and/or to extend the upper arm means, as required.

The equipment associated with each motor for operation thereof is essentially similar, each motor being supplied with hydraulic fluid from a reservoir 40 by means of a pump driven by a motor usually an electric motor supplied from a battery carried on the frame 20. Alternatively the pump may be driven by a small gasoline or diesel engine.

The liquid from the hydraulic motor is returned through an adjustable flow control valve, which permits the rate of movement of the platform to be controlled. All of the operating mechanism comprising the battery, motors, pumps, etc., are contained in a simple enclosure 96 mounted on the frame 20. A complete control system of suitable type is described for example in my prior U.S. Pat. Ser. No. 3,807,575, issued Apr. 30, 1974, to which reference may be made.

I claim:

1. An elevating device comprising base means;

a telescoping arm means pivotally connected at one end to the said base means and having a man-carrying platform pivotally pendulously suspended at the other end so as to remain in a vertical attitude under the action of gravity, during movement thereof;

motor means operatively connected between the base means and the telescoping arm means to elevate and lower the platform relative to the base means;

second motor means operatively connected between the telescoping parts of the telescoping arm means to extend and contact it for corresponding movement of the platform;

a telescoping torque transmitting shaft disposed alongside the telescoping arm means and telescopable therewith;

a first link means connecting one end of the telescoping shaft and the base means for rotation of the shaft through an angle corresponding to the pivoting of the second arm means relative to the base means; and a second link means connecting the other end of the telescoping shaft and the platform and movable by said rotation of the shaft to maintain the platform in its said vertical attitude.

2. An elevating device as claimed in claim 1, wherein each said link means comprises a radially-extending link arm fastened to the shaft to be rotatable about the longitudinal axis thereof, and a connecting member connecting the respective link arm to the base means or to the platform.

3. An elevating device as claimed in claim 1, wherein the said connecting member of one of the said link means includes resilient means adapted to absorb impact forces applied to the platform and thence to the torque transmitting shaft.

4. An elevating device as claimed in claim 1, wherein the said telescoping arm means comprise two hollow telescoping arm members and the said second motor means and the telescoping shaft are enclosed within the hollow arm members.

5. An elevating device as claimed in claim 1, wherein the said base means comprise:

a second arm means pivotally connected at one end to a base member and at the other end to a post member;

the said telescoping arm means being pivotally connected to the said post member; and third motor means operatively connected between the said base member and the second arm means to elevate and lower the said post member, and thereby the said telescoping arm means, relative to the said base member.

6. An elevating device as claimed in claim 5, wherein the said second arm means comprise an elongated parallelogram linkage having as two shorter parallel sides thereof a vertical post member of the base member and the first mentioned post member, so that the first-mentioned post member automatically remains vertical during its said elevating and lowering movements.

7. An elevating device as claimed in claim 5, wherein each said link means comprises a radially-extending link arm fastened to the shaft to be rotatable about the longitudinal axis thereof, and a connecting member connecting the respective link arm to the base means or to the platform, wherein the said connecting member of one of the said link means includes resilient means adapted to absorb impact forces applied to the platform and thence to the torque transmitting shaft, and wherein the said second arm means comprise an elongated parallelogram linkage having as two shorter parallel sides thereof a vertical post member of the base member and the first mentioned post member, so that the first-mentioned post member automatically remains vertical during its said elevating and lowering movements.

8. An elevating device as claimed in claim 5, wherein each said link means comprises a radially-extending link arm fastened to the shaft to be rotatable about the longitudinal axis thereof, and a connecting member connecting the respective link arm to the base means or to the platform, and wherein the said connecting member of one of the said link means includes resilient means adapted to absorb impact forces applied to the platform and thence to the torque transmitting shaft.

9. An elevating device as claimed in claim 5, wherein the said post member is skewed along its length between its respective connections with the telescoping and second arm means to permit the said arm means to move alongside each other.

* * * * *